US011964217B2

(12) United States Patent
Huang

(10) Patent No.: US 11,964,217 B2
(45) Date of Patent: Apr. 23, 2024

(54) ARCHAEOLOGICAL AND TREASURE-DIGGING TOY AND MANUFACTURING METHOD THEREOF

(71) Applicant: Shenzhen BLACK TECH Co., Ltd., Shenzhen (CN)

(72) Inventor: Lianwu Huang, Shenzhen (CN)

(73) Assignee: SHENZHEN BLACK TECH CO., LTD., Shenzhen (CN)

( * ) Notice: Subject to any disclaimer, the term of this patent is extended or adjusted under 35 U.S.C. 154(b) by 0 days.

(21) Appl. No.: 18/330,378

(22) Filed: Jun. 7, 2023

(65) Prior Publication Data

US 2023/0311018 A1 Oct. 5, 2023

(51) Int. Cl.
*A63H 33/32* (2006.01)
*A63H 9/00* (2006.01)

(52) U.S. Cl.
CPC ..... *A63H 33/32* (2013.01); *A63H 9/00* (2013.01)

(58) Field of Classification Search
CPC . A63H 3/38; A63H 33/26; G09B 1/10; G09B 23/28; G09B 23/308; G09B 23/30; G09B 23/36; G09B 25/08
USPC ..... 434/131, 154, 306, 296; 446/73, 75, 76
See application file for complete search history.

(56) References Cited

U.S. PATENT DOCUMENTS 3,613,265 A * 10/1971 Stern et al. ..... G09B 23/36 434/297
3,698,101 A * 10/1972 Bowling ..... G09B 23/36 206/509
5,176,519 A * 1/1993 Albanchez Matiaci . G01N 1/36 434/296
5,480,308 A * 1/1996 Boundy ..... G09B 23/38 434/296
6,106,302 A * 8/2000 Schumacher ..... G09B 23/36 434/296
2006/0188851 A1 8/2006 Duprey
2017/0236430 A1 8/2017 Kalia et al.
2019/0022545 A1 1/2019 Gunawardana

* cited by examiner

*Primary Examiner* — Kien T Nguyen
(74) *Attorney, Agent, or Firm* — Zhigang Ma

(57) ABSTRACT

The present disclosure provides an archaeological and treasure-digging toy and a manufacturing method thereof. The archaeological and treasure-digging toy includes an ornament, an inclusion and a carrier. The inclusion wraps the ornament therein and has a smooth outer surface. The carrier wraps the inclusion therein.

10 Claims, 8 Drawing Sheets

ARCHAEOLOGICAL AND TREASURE-DIGGING TOY AND MANUFACTURING METHOD THEREOF

TECHNICAL FIELD

The present disclosure relates to the toy field, in particular to an archaeological and treasure-digging toy and a manufacturing method thereof.

BACKGROUND

At present, toys have become an indispensable part in children's life, and they can not only bring fun and stimulation, but also promote children's physical and intellectual development. However, most of the existing toys in the market are lacking of educational content, so some parents worry that these toys will have negative effects on children's growth and learning. Therefore, the educational and informative toys are required, and the archaeological and treasure-digging toy is just such a toy, which may help children learn the knowledge in aspects of biology, geography, history and the like, and cultivate children's inquisitive spirit and logical thinking.

SUMMARY

The present disclosure provides an archaeological and treasure-digging toy comprising: an ornament; an inclusion wrapping the ornament therein and including a smooth outer surface; and a carrier wrapping the inclusion therein.

Further, the ornament includes at least one biological specimen.

Further, the biological specimen includes at least one of an insect, a plant and a shellfish.

Further, the inclusion is made of a resin material.

Further, the inclusion is a transparent inclusion.

Further, the inclusion is a light-yellow transparent inclusion.

Further, the inclusion is a rigid inclusion.

Further, the smooth outer surface is formed by grinding and polishing an outer surface of the inclusion.

Further, the carrier includes a filling powder, a foamed thermal expansion microsphere, sand, silver nitrate, cellulose cyclodextrin, a preservative, a color paste and water, which are mutually mixed and dried to form the carrier.

Further, the carrier is a rectangular block carrier, or a trapezoidal block carrier, or a spherical block carrier, or an elliptic block carrier or a pyramidal block carrier.

Further, raised or depressed decorative patterns are provided on an outer surface of the carrier.

The present disclosure also provides a manufacturing method for an archaeological and treasure-digging toy, including the following steps of: providing an ornament; wrapping the ornament by a inclusion, the inclusion including a smooth outer surface after wrapping; and providing a carrier wrapping the inclusion.

Further, the step of providing the ornament includes: providing a material for the ornament, wherein the material includes at least one biological specimen and a Carr's liquid from an insect, a plant and a shellfish; and soaking the biological specimen in the Carr's liquid, and obtaining the ornament after standing.

Further, the step of wrapping the ornament by a inclusion includes: providing an epoxy resin and a curing agent; obtaining a wrapping paste after mixing the epoxy resin and the curing agent; covering the wrapping paste on the surface of the ornament, and forming the inclusion or wrapping the ornament therein after curing; and grinding and polishing the inclusion, forming a smooth outer surface layer on an outer surface of the inclusion, and obtaining the inclusion providing the smooth outer surface.

Further, the wrapping paste is obtained after mixing the epoxy resin with the curing agent in a ratio of 3:1.

Further, the step of providing a carrier wrapping the inclusion includes providing a filling powder, a foamed thermal expansion microsphere, sand, silver nitrate, cellulose cyclodextrin, a preservative, a color paste and water; mixing the filling powder, the foamed thermal expansion microsphere, the sand, the silver nitrate, the cellulose cyclodextrin, the preservative, the color paste and the water, to form a carrier paste; and covering the carrier paste on the surface of the inclusion with the smooth outer surface, and obtaining the carrier internally inlaid with the inclusion with the smooth outer surface after drying.

Further, the filling powder is any one or a mixture of more of a gypsum powder, a clay powder, a talcum powder, a mica powder, an attapulgite powder and a montmorillonoid powder.

Further, the stand is any one or a mixture of more of river sand, lake sand, sea sand, hill sand and machine-made sand.

Further, the foamed thermal expansion microsphere is a dry powder foamed thermal expansion microsphere or a filter cake foamed thermal expansion microsphere.

Further, the water is sterile tap water or pure water.

Through the above structure, the ornament is wrapped in the inclusion with the smooth outer surface, the inclusion is smooth and not easily contaminated by dust, and then the inclusion is inlaid into the carrier to be made into the archaeological and treasure-digging toy, so as to simulate a forming state of palaeobios and a digging process of an ancient civilization relic. A user may knock, cut and scrape the carrier by using a specific tool until the inclusion inlaid in the carrier is dug. Since the inclusion has a smooth surface, when the user digs the inclusion from the carrier, the dust contaminated on the inclusion may be cleaned easily through a sweeping tool. During this process, the user's practical experience and understanding for the history and the ancient civilization may be increased, and the user's operational ability, observation ability and imagination may be cultivated. With simple process and design, the toy effectively solves the problem of an expensive manufacturing cost and may be widely applied in the toy industry.

DETAILED DESCRIPTION OF THE EMBODIMENTS

Embodiment I

Figure 1:
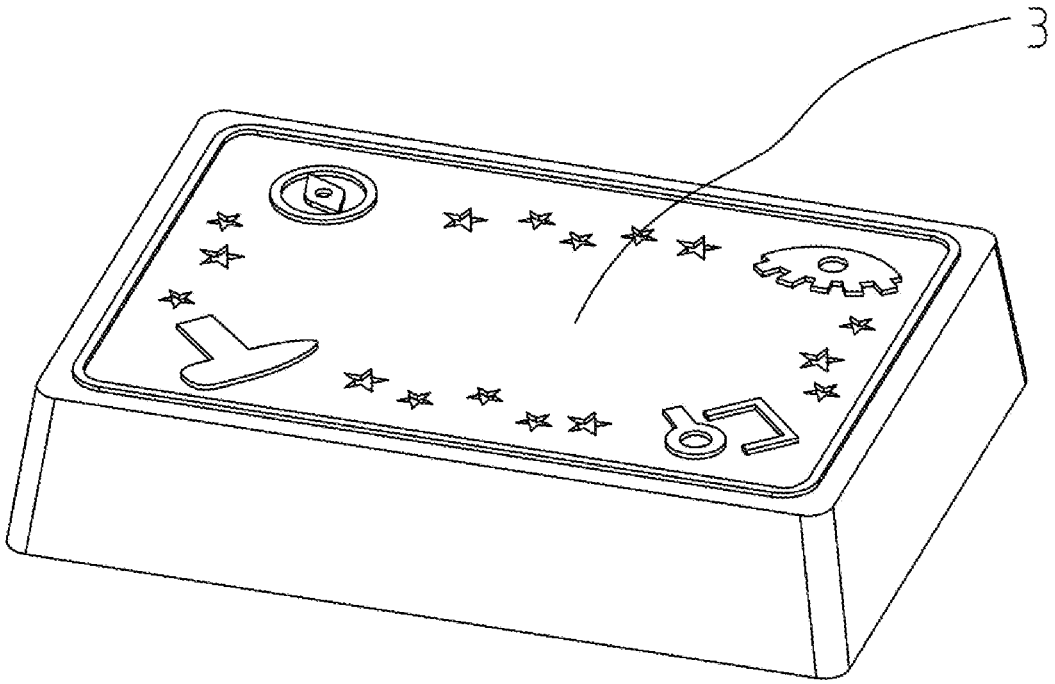
FIG. 1 is a schematic diagram of a solid structure of an archaeological and treasure-digging toy in the present disclosure.
Figure 2:
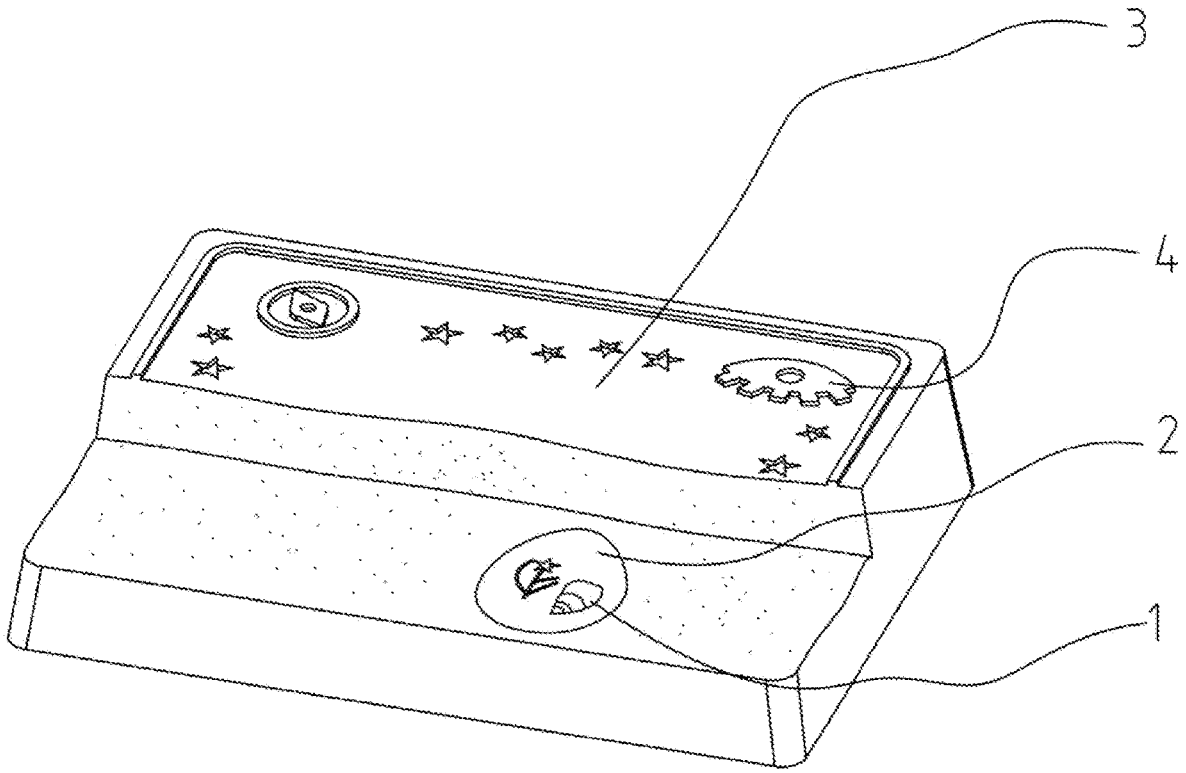
FIG. 2 is a structure schematic diagram of an archaeological and treasure-digging toy during digging in the present disclosure.
Figure 3:
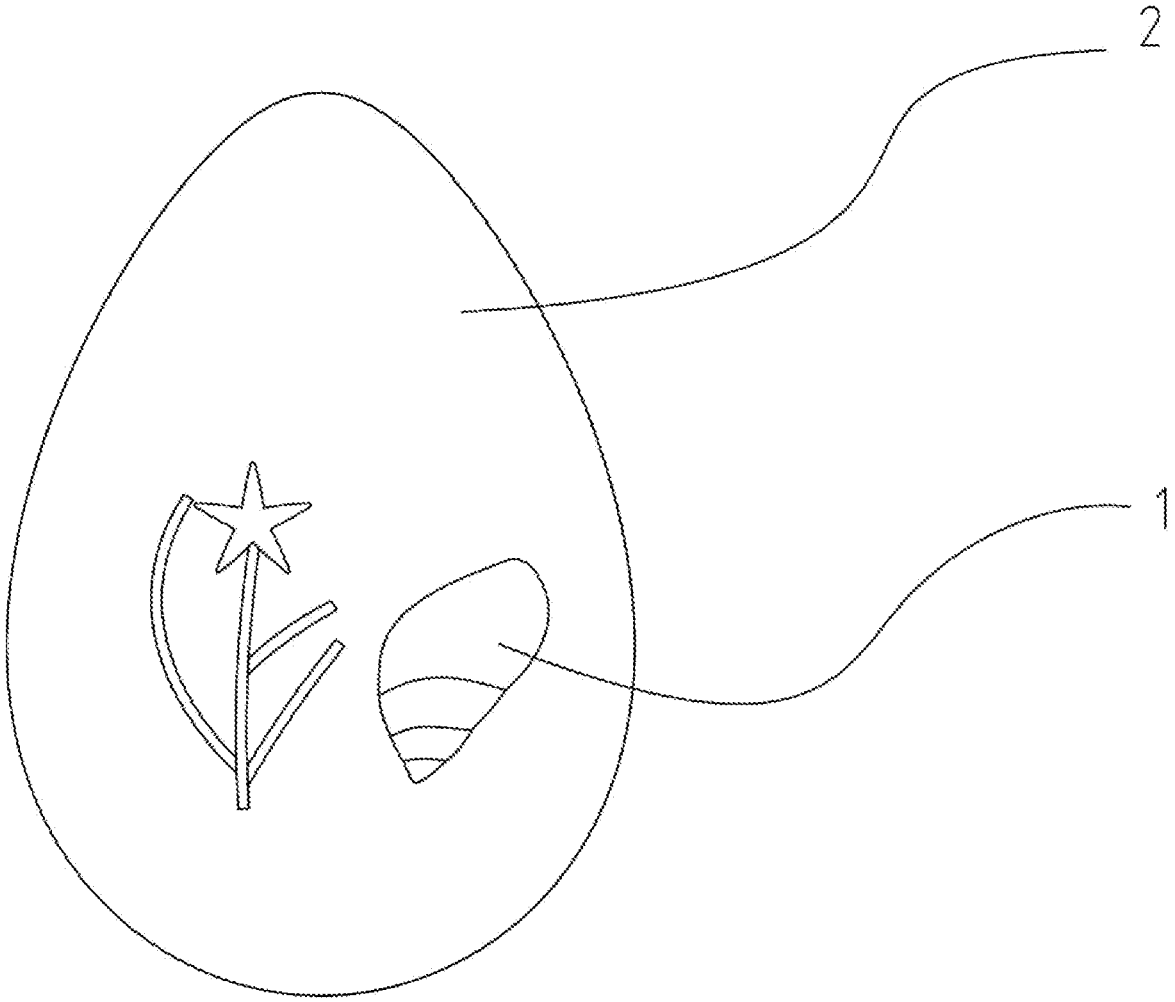
FIG. 3 is a schematic diagram of a solid structure of an inclusion of an archaeological and treasure-digging toy in the present disclosure.
Figure 4:
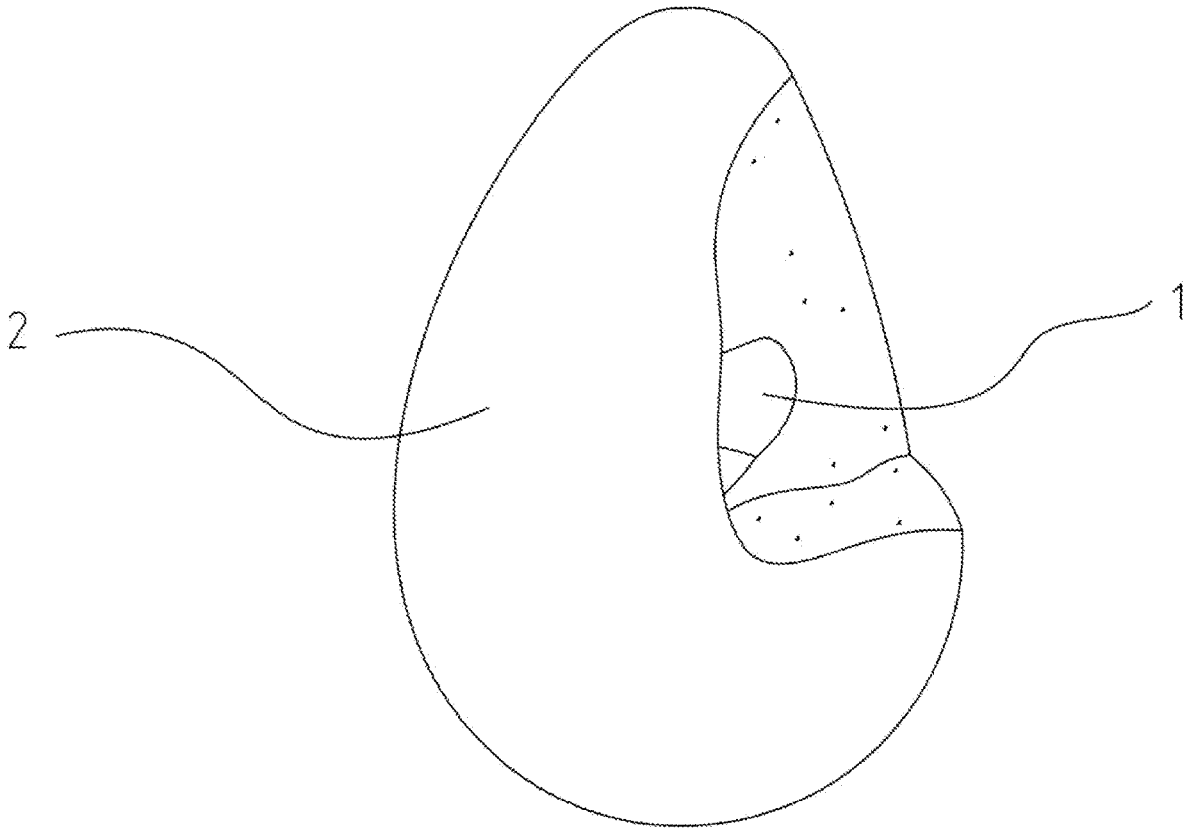
FIG. 4 is a structure schematic diagram of an inclusion of an archaeological and treasure-digging toy in the present disclosure.

Referring to FIGS. 1 to 4, an archaeological and treasure-digging toy includes an ornament 1, an inclusion 2 and a carrier 3. The inclusion 2 wraps the ornament therein and has a smooth outer surface. The carrier 3 wraps the inclusion 2 therein.

Through the above structure, the ornament is wrapped in the inclusion with the smooth outer surface, the inclusion is smooth and not easily contaminated by dust, and then the inclusion is inlaid into the carrier to be made into the archaeological and treasure-digging toy, so as to simulate a forming state of palaeobios and a digging process of an ancient civilization relic. A user may knock, cut and scrape the carrier by using a specific tool until the inclusion inlaid in the carrier is dug. Since the inclusion has a smooth surface, when the user digs the inclusion from the carrier, the dust contaminated on the inclusion may be cleaned easily through a sweeping tool. During this process, the user's practical experience and understanding for the history and the ancient civilization may be increased, and the user's operational ability, observation ability and imagination may be cultivated. With simple process and design, the toy effectively solves the problem of an expensive manufacturing cost and may be widely applied in the toy industry.

In this embodiment, the ornament 1 includes at least one biological specimen, where the biological specimen is from an insect, a plant and a shellfish, further the insect include a spider, a butterfly, a beetle, a mantis and other interesting insects, the plant includes a leaf, a seed, a petal and other small plants, and the shellfish includes a sea snail, a scallop, a conch and other shellfishes with beautiful modeling. The ornament made by these biological specimens is beautiful in shape, so as to more attract the user's exploratory curiosity and purchasing desire.

In this embodiment, the inclusion 2 is made of a resin material, and further the inclusion 2 is a light-yellow transparent inclusion. Through the above structure, the inclusion made of the resin material is light-yellow and transparent, so as to simulate the form, color and transparency of a natural amber, and the vivid and bright ambroid is made; and the user can clearly observe the ornament wrapped in the inclusion through the transparent inclusion, thereby increasing the beauty and attraction.

In this embodiment, the inclusion 2 is a rigid inclusion. Through the above structure, the inclusion has a higher hardness, so that the inclusion is more wearable, so as to resist the daily wearing and scratch, reduce the surface damage and wearing and maintain the integrity and beauty.

In this embodiment, the smooth outer surface is formed by grinding and polishing the outer surface of the inclusion. Through the above structure, the surface of the inclusion is smooth and glossy by grinding and polishing the inclusion, and when the user digs the inclusion from the carrier, the dust contaminated on the surface may be easily cleaned, so as to obtain the clean inclusion with the smooth surface.

In this embodiment, the carrier 3 includes a filling powder, a foamed thermal expansion microsphere, sand, silver nitrate, cellulose cyclodextrin, a preservative, a color paste and water, which are mutually mixed and dried to form the carrier 3. Through the above structure, after the carrier materials are mixed, the carrier has a certain hardness and plasticity, meanwhile the carrier is more fragile than the real soil, which makes the user easily dig the inclusion hidden in the carrier and is helpful for increasing the playing joy and sense of achievement.

In this embodiment, the carrier 3 is a rectangular block carrier, or a trapezoidal block carrier, or a spherical block carrier, or an elliptic block carrier or a pyramidal block carrier. Through the above structure, the carrier has a diversified modeling, including a rectangular block, a trapezoidal block, a spherical block, an elliptic block, a pyramidal block, an irregular body and the like, and the diversified modeling can provide multiple choices to the user in order to meet multiple demands of various users.

In this embodiment, raised or depressed decorative patterns 4 are provided on an outer surface of the carrier 3. Through the above structure, the raised or depressed decorative patterns are designed on the surface of the carrier, so as to increase the beauty and the artistic effect of the archaeological and treasure-digging toy and attract the user's purchasing.

Embodiment II

Figure 5:
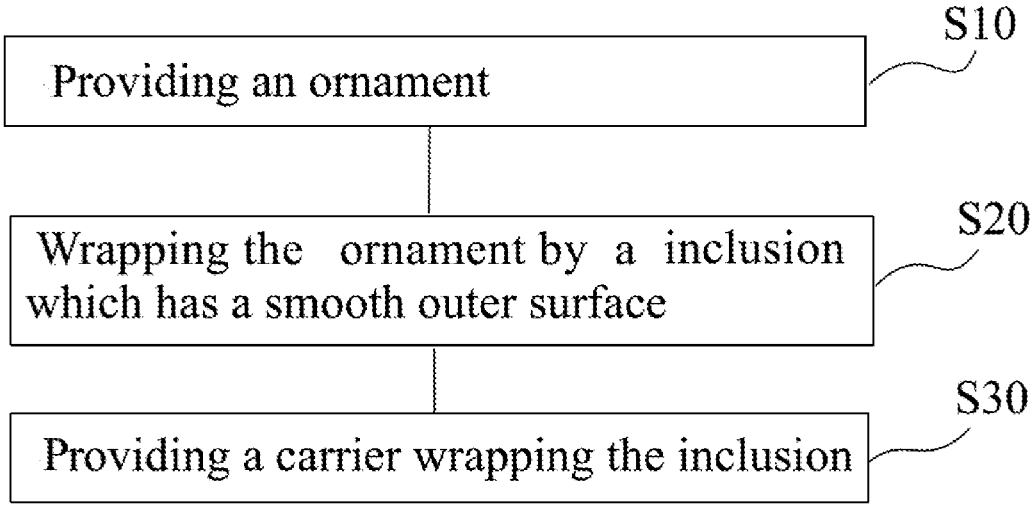
FIG. 5 is a process diagram of Embodiment II of an archaeological and treasure-digging toy in the present disclosure.
Figure 6:
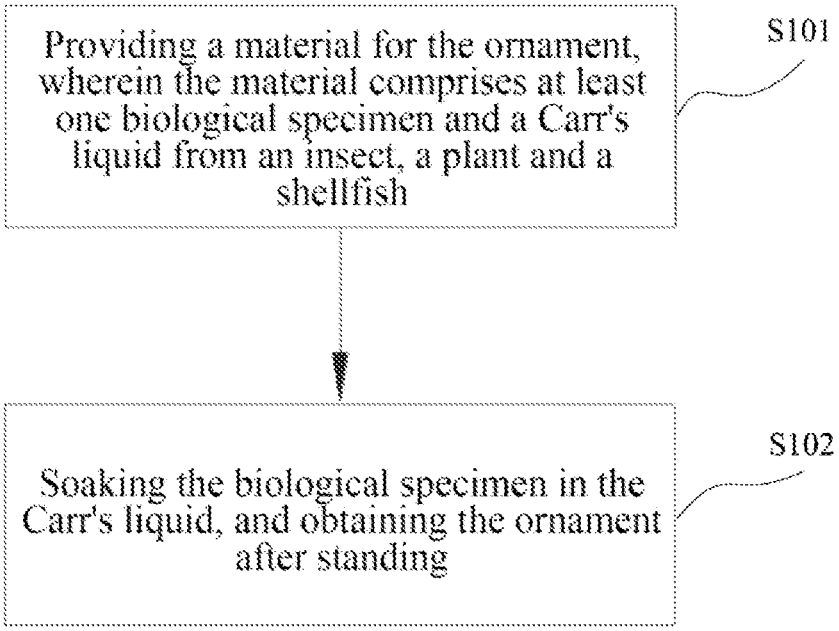
FIG. 6 is another process diagram of Embodiment II of an archaeological and treasure-digging toy in the present disclosure.
Figure 7:
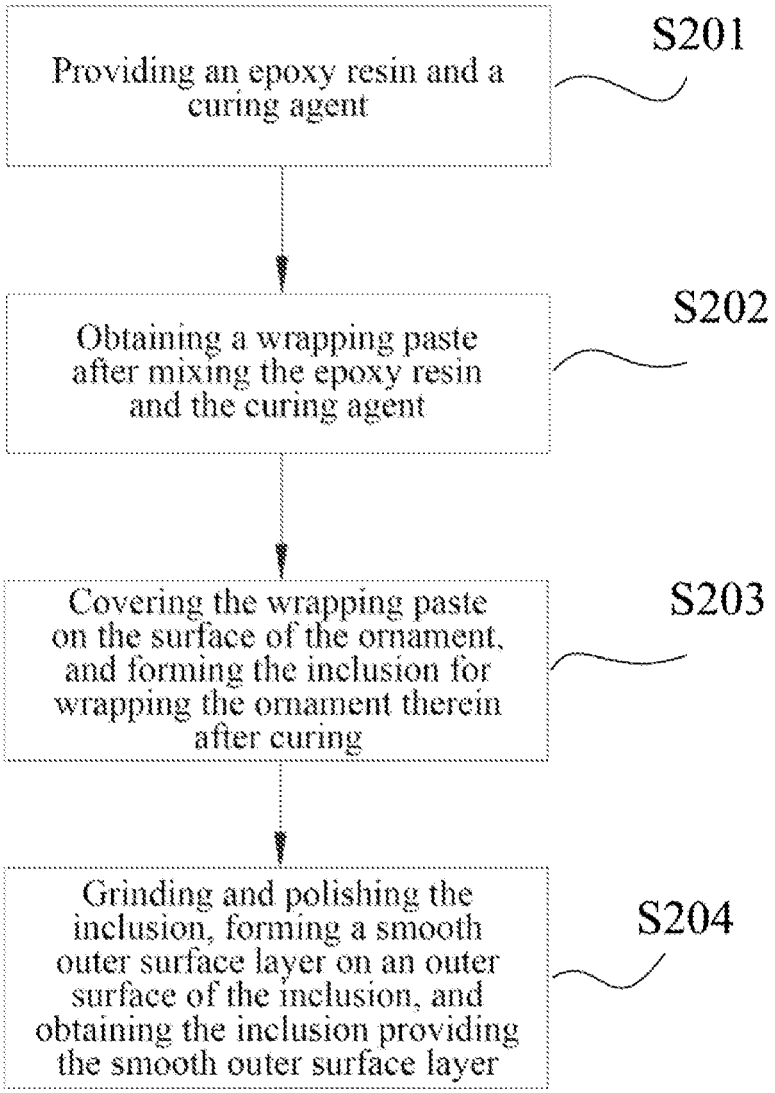
FIG. 7 is a yet process diagram of Embodiment II of an archaeological and treasure-digging toy in the present disclosure.
Figure 8:
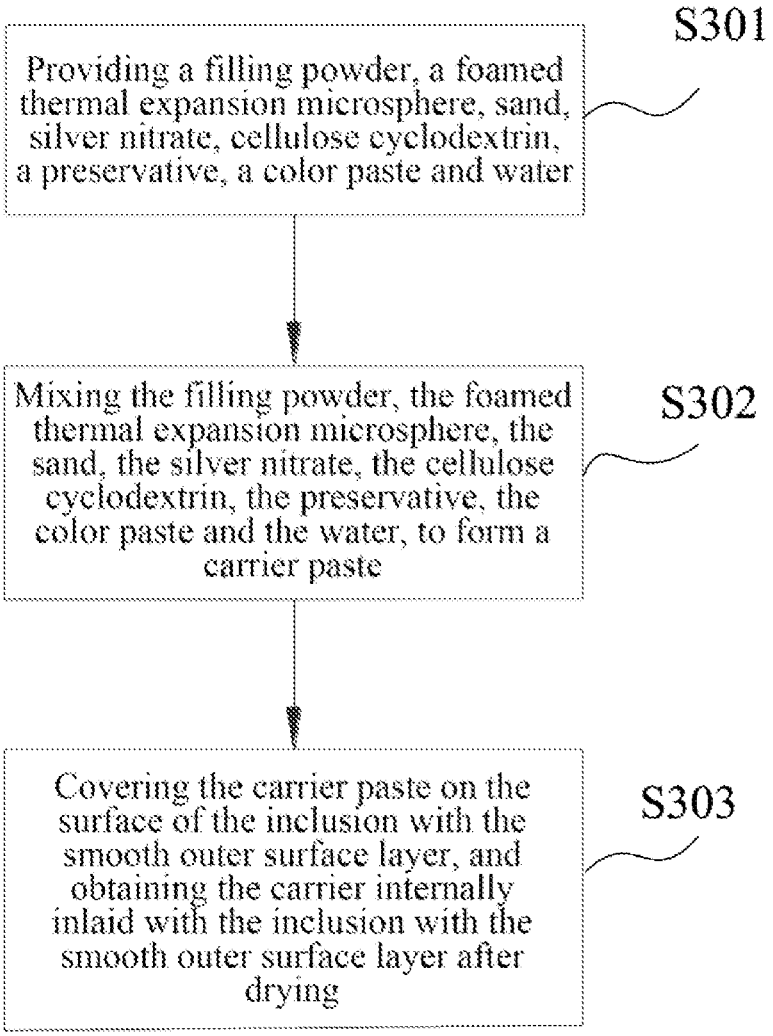
FIG. 8 is a still process diagram of Embodiment II of an archaeological and treasure-digging toy in the present disclosure.

Referring to FIGS. 5 to 8, a manufacturing method for an archaeological and treasure-digging toy, including the following steps:

S10: providing an ornament 1;

This step S10 includes:

S101: providing at least one biological specimen and a Carr's liquid from an insect, a plant and a shellfish; and

S102: soaking the biological specimen in the Carr's liquid, and obtaining the ornament 1 after standing.

Through the above steps, at least one creature of the insect, plant and shellfish is taken, cleaned with absolute ethyl alcohol, subjected to post finishing, and soaked in the Carr's liquid, and the ornament is obtained after standing. The Carr's liquid is suitable for color retention of arthropod, mollush and plants, and shells of most insects are fixed through a regular method, oxidation and stain are easily caused; and however the Carr's liquid has an excellent antioxidant effect, so the biological specimen obtained through the Carr's liquid may keep the most perfect form, so that the user can observe the real animal traces, thereby increasing the authenticity and interest of the treasure-digging toy.

S20: wrapping the ornament 1 by a inclusion 2 which has a smooth outer surface after wrapping; and This step S20 includes:

S201: providing an epoxy resin and a curing agent;

S202: obtaining a wrapping paste after mixing the epoxy resin and the curing agent; and

S203: obtaining the wrapping paste after mixing the epoxy resin and the curing agent;

S204: grinding and polishing the inclusion 2, forming a smooth outer surface layer on an outer surface of the inclusion 2, and obtaining the inclusion 2 providing the smooth outer surface.

Through the above steps, the epoxy resin is mixed with the curing agent in a mass ratio of 3:1, attention should be paid to stirring immediately after mixing until there is no visible floccule; a volume ratio of the epoxy resin to the curing agent is 2.5:1, since a temperature will slightly affect the volume of the two, the mass ratio is more accurate, and usually the volume ratio is not used; and if the ratio is improper, the phenomenon that the epoxy resin mixing paste cannot be cured may occur. The wrapping past obtained after mixing is covered on the surface of the ornament, the inclusion for wrapping the ornament therein is formed after curing, the inclusion is transparent, and the user can observe the ornament wrapped therein with naked eyes. The cured inclusion is ground through the sand paper, a great amount of powder will produce during the grinding process, and a water mill method is used for grinding, so as to avoid absorbing a great amount of powder for convenient subsequent cleaning. In order to increase the contact area between the sand paper and the inclusion, and meanwhile to prevent the stand paper from being worn, a wet cloth may be padded between the sand paper and a flat desktop, and when the water on the sand paper becomes turbid, the moisture must be wiped in time and the sand paper and the inclusion are flushed in time. After the grinding is completed through the sand paper, the hand feeling of the inclusion surface is fine and smooth, only the transparency is to be improved, the inclusion is cleaned and dried, and wiped repeatedly through a polishing block until a mirror effect occurs.

S30: providing a carrier (3) wrapping the inclusion (2). This step S30 includes:

S301: providing a filling powder, a foamed thermal expansion microsphere, sand, silver nitrate, cellulose cyclodextrin, a preservative, a color paste and water;

S302: mixing the filling powder, the foamed thermal expansion microsphere, the sand, the silver nitrate, the cellulose cyclodextrin, the preservative, the color paste and the water, to form a carrier paste;

S303: covering the carrier paste on the surface of the inclusion 2 with the smooth outer surface, and obtaining the carrier 3 internally inlaid with the inclusion 2 with the smooth outer surface after drying.

Through the above steps, a mixture of the foamed thermal expansion microsphere, the sand, the sterile tap water, the silver nitrate, the cellulose cyclodextrin, the color paste, the phosphorous sulfur gypsum powder, the river sand and the lake sand, and the preservative with a mass ratio of 4.5:1.2 are weighed respectively; the weighed sterile tap water and the foamed thermal expansion microsphere filter cake are poured into a stirrer to be stirred for 30 s, to ensure that the foamed thermal expansion microsphere is uniformly dispersed in the sterile tap water; the preservative and the silver nitrate with a mass ratio of 4.5:1.2 are added into the obtained mixture to be sterilized for 20 min and then stirred for 30 s again, and the obtained mixture is transferred to a blender mixer, the mixture of the phosphorous sulfur gypsum powder, the river and the lake sand, the cellulose cyclodextrin and the color paste are successively added, and transferred to a drying room for drying after being uniformly mixed and forming the paste, and finally the carrier inlaid with the inclusion with the smooth outer surface is obtained. The manufacturing material is low in cost and the process is simple, so the process complies with the safety standards. When the user adopts the digging tool to dig the ornament, an effect of mixing the false with the genuine may be achieved.

Through the above embodiment steps, the technological process of the archaeological and treasure-digging toy is effectively realized, and the ornament is inlaid inside the carrier after the inclusion wraps the ornament inside by providing the ornament, the inclusion and the carrier. The user can use a digging tool, such as a hammer and a knife, to lightly knock and scrape the carrier until the dust on the inclusion is wiped through a brush when the inclusion is exposed from the carrier, and then the transparent and smooth inclusion wrapped with the ornament can be seen; and the cleaned inclusion is clean and transparent and has a very high ornamental value.

What is claimed is:

1. An archaeological and treasure-digging toy, comprising:

an ornament (1);

an inclusion (2) wrapping the ornament therein and comprising a smooth outer surface; and a carrier (3) wrapping the inclusion (2) therein, wherein the carrier (3) comprises a filling powder, a foamed thermal expansion microsphere, sand, silver nitrate, cellulose cyclodextrin, a preservative, a color paste and water, which are mutually mixed and dried to form the carrier.

2. The archaeological and treasure-digging toy according to claim 1, wherein the ornament comprises at least one biological specimen.

3. The archaeological and treasure-digging toy according to claim 2, wherein the biological specimen comprises at least one of an insect, a plant and a shellfish.

4. The archaeological and treasure-digging toy according to claim 1, wherein the inclusion (2) is made of a resin material.

5. The archaeological and treasure-digging toy according to claim 1, wherein the inclusion (2) is a transparent inclusion.

6. The archaeological and treasure-digging toy according to claim 1, wherein the inclusion (2) is a light-yellow transparent inclusion.

7. The archaeological and treasure-digging toy according to claim 1, wherein the inclusion (2) is a rigid inclusion.

8. The archaeological and treasure-digging toy according to claim 1, wherein the smooth outer surface is formed by grinding and polishing an outer surface of the inclusion.

9. The archaeological and treasure-digging toy according to claim 1, wherein the carrier (3) is a rectangular block carrier, or a trapezoidal block carrier, or a spherical block carrier, or an elliptic block carrier or a pyramidal block carrier.

10. The archaeological and treasure-digging toy according to claim 1, wherein raised or depressed decorative patterns (4) are provided on an outer surface of the carrier (3).

* * * * *